US007070478B2

(12) United States Patent
Elledge et al.

(10) Patent No.: US 7,070,478 B2
(45) Date of Patent: Jul. 4, 2006

(54) SYSTEMS AND METHODS FOR MONITORING CHARACTERISTICS OF A POLISHING PAD USED IN POLISHING MICRO-DEVICE WORKPIECES

(75) Inventors: Jason B. Elledge, Boise, ID (US); Nagasubramaniyan Chandrasekaran, Boise, ID (US)

(73) Assignee: Micron Technology, Inc., Boise, ID (US)

( * ) Notice: Subject to any disclaimer, the term of this patent is extended or adjusted under 35 U.S.C. 154(b) by 3 days.

(21) Appl. No.: 10/930,314

(22) Filed: Aug. 31, 2004

(65) Prior Publication Data

US 2005/0032461 A1 Feb. 10, 2005

Related U.S. Application Data

(62) Division of application No. 10/379,035, filed on Mar. 3, 2003, now Pat. No. 6,872,132.

(51) Int. Cl.
*B24B 1/00* (2006.01)

(52) U.S. Cl. ..... 451/6; 451/8; 451/9; 451/10; 451/41; 451/56; 451/289

(58) Field of Classification Search ..... 451/5, 451/6, 8–10, 21, 41, 56, 59, 285–290; 438/692–693; 73/602

See application file for complete search history.

(56) References Cited

U.S. PATENT DOCUMENTS 4,498,345 A 2/1985 Dyer et al.
4,501,258 A 2/1985 Dyer et al.
4,502,459 A 3/1985 Dyer
4,971,021 A 11/1990 Kubotera et al.
5,036,015 A 7/1991 Sandhu et al.
5,069,002 A 12/1991 Sandhu et al.
5,081,796 A 1/1992 Schultz
5,163,334 A 11/1992 Li et al.
5,222,329 A 6/1993 Yu
5,232,875 A 8/1993 Tuttle et al.
5,234,867 A 8/1993 Schultz et al.
5,240,552 A 8/1993 Yu et al.
5,244,534 A 9/1993 Yu et al.

(Continued)

OTHER PUBLICATIONS

Bhardwaj, M.C., et al. "Introduction To Contact-Free Ultrasonic Characterization and Analysis of Consolidated Materials," pp. 1-13, Presented at the Applications of Non-Destructive Evaluation in Powder Metals Seminar, Iowa State University, Ames, Iowa. Apr. 25, 2000.

(Continued)

*Primary Examiner*—George Nguyen
(74) *Attorney, Agent, or Firm*—Perkins Coie LLP

(57) ABSTRACT

Systems and methods for monitoring characteristics of a polishing pad used in polishing a micro-device workpiece are disclosed herein. In one embodiment, a method for monitoring a characteristic of a polishing pad includes applying ultrasonic energy to the polishing pad and determining a status of the characteristic based on a measurement of the ultrasonic energy applied to the polishing pad. In one aspect of this embodiment, applying ultrasonic energy includes applying ultrasonic energy from a transducer. The transducer can be carried by a conditioner, a fluid arm, a micro-device workpiece carrier, or a table. In another aspect of this embodiment, determining the status of the characteristic includes determining a thickness, density, surface contour, roughness, or texture of the polishing pad.

35 Claims, 6 Drawing Sheets

U.S. PATENT DOCUMENTS

| | | | | |
|---|---|---|---|---|
| 5,245,790 | A | 9/1993 | Jerbic | |
| 5,245,796 | A | 9/1993 | Miller et al. | |
| RE34,425 | E | 11/1993 | Schultz | |
| 5,413,941 | A | 5/1995 | Koos et al. | |
| 5,421,769 | A | 6/1995 | Schultz et al. | |
| 5,433,649 | A | 7/1995 | Nishida | |
| 5,433,651 | A | 7/1995 | Lustig et al. | |
| 5,439,551 | A | 8/1995 | Meikle et al. | |
| 5,449,314 | A | 9/1995 | Meikle et al. | |
| 5,486,120 | A | 1/1996 | McMills et al. | |
| 5,514,245 | A | 5/1996 | Doan et al. | |
| 5,522,965 | A * | 6/1996 | Chisholm et al. | 438/693 |
| 5,533,924 | A | 7/1996 | Stroupe et al. | |
| 5,540,810 | A | 7/1996 | Sandhu et al. | |
| 5,573,442 | A | 11/1996 | Morita et al. | |
| 5,618,381 | A | 4/1997 | Doan et al. | |
| 5,618,447 | A * | 4/1997 | Sandhu | 438/14 |
| 5,632,666 | A | 5/1997 | Peratello et al. | |
| 5,643,048 | A | 7/1997 | Iyer | |
| 5,643,060 | A | 7/1997 | Sandhu et al. | |
| 5,658,183 | A | 8/1997 | Sandhu et al. | |
| 5,658,190 | A | 8/1997 | Wright et al. | |
| 5,663,797 | A | 9/1997 | Sandhu | |
| 5,664,988 | A | 9/1997 | Stroupe et al. | |
| 5,668,061 | A | 9/1997 | Herko et al. | |
| 5,679,065 | A | 10/1997 | Henderson | |
| 5,681,204 | A | 10/1997 | Kawaguchi et al. | |
| 5,688,364 | A * | 11/1997 | Sato | 438/693 |
| 5,700,955 | A | 12/1997 | Roth | |
| 5,702,292 | A | 12/1997 | Brunelli et al. | |
| 5,708,506 | A * | 1/1998 | Birang | 356/600 |
| 5,730,642 | A | 3/1998 | Sandhu et al. | |
| 5,738,562 | A | 4/1998 | Doan et al. | |
| 5,747,386 | A | 5/1998 | Moore | |
| 5,777,739 | A | 7/1998 | Sandhu et al. | |
| 5,792,709 | A | 8/1998 | Robinson et al. | |
| 5,795,495 | A | 8/1998 | Meikle | |
| 5,798,302 | A | 8/1998 | Hudson et al. | |
| 5,807,165 | A | 9/1998 | Uzoh et al. | |
| 5,830,806 | A | 11/1998 | Hudson et al. | |
| 5,851,135 | A | 12/1998 | Sandhu et al. | |
| 5,855,804 | A | 1/1999 | Walker | |
| 5,868,896 | A | 2/1999 | Robinson et al. | |
| 5,882,248 | A | 3/1999 | Wright et al. | |
| 5,893,754 | A | 4/1999 | Robinson et al. | |
| 5,895,550 | A | 4/1999 | Andreas | |
| 5,910,846 | A | 6/1999 | Sandhu | |
| 5,934,973 | A | 8/1999 | Boucher et al. | |
| 5,934,980 | A | 8/1999 | Koos et al. | |
| 5,936,733 | A | 8/1999 | Sandhu et al. | |
| 5,945,347 | A | 8/1999 | Wright | |
| 5,954,912 | A | 9/1999 | Moore | |
| 5,967,030 | A | 10/1999 | Blalock | |
| 5,972,792 | A | 10/1999 | Hudson | |
| 5,980,363 | A | 11/1999 | Meikle et al. | |
| 5,981,396 | A | 11/1999 | Robinson et al. | |
| 5,994,224 | A | 11/1999 | Sandhu et al. | |
| 5,997,384 | A | 12/1999 | Blalock | |
| 6,006,739 | A | 12/1999 | Akram et al. | |
| 6,007,408 | A | 12/1999 | Sandhu | |
| 6,039,633 | A | 3/2000 | Chopra | |
| 6,040,245 | A | 3/2000 | Sandhu et al. | |
| 6,046,111 | A | 4/2000 | Robinson | |
| 6,054,015 | A | 4/2000 | Brunelli et al. | |
| 6,057,602 | A | 5/2000 | Hudson et al. | |
| 6,066,030 | A | 5/2000 | Uzoh | |
| 6,074,286 | A | 6/2000 | Ball | |
| 6,083,085 | A | 7/2000 | Lankford | |
| 6,108,092 | A | 8/2000 | Sandhu | |
| 6,110,820 | A | 8/2000 | Sandhu et al. | |
| 6,113,462 | A | 9/2000 | Yang | |
| 6,116,988 | A | 9/2000 | Ball | |
| 6,120,354 | A | 9/2000 | Koos et al. | |
| 6,135,856 | A | 10/2000 | Tjaden et al. | |
| 6,139,402 | A | 10/2000 | Moore | |
| 6,143,123 | A | 11/2000 | Robinson et al. | |
| 6,143,155 | A | 11/2000 | Adams et al. | |
| 6,152,803 | A | 11/2000 | Boucher et al. | |
| 6,152,808 | A | 11/2000 | Moore | |
| 6,176,992 | B1 | 1/2001 | Talieh | |
| 6,184,571 | B1 | 2/2001 | Moore | |
| 6,186,864 | B1 | 2/2001 | Fisher et al. | |
| 6,187,681 | B1 | 2/2001 | Moore | |
| 6,190,494 | B1 | 2/2001 | Dow | |
| 6,191,037 | B1 | 2/2001 | Robinson et al. | |
| 6,191,864 | B1 | 2/2001 | Sandhu | |
| 6,193,588 | B1 | 2/2001 | Carlson et al. | |
| 6,200,901 | B1 | 3/2001 | Hudson et al. | |
| 6,203,404 | B1 | 3/2001 | Joslyn et al. | |
| 6,203,413 | B1 | 3/2001 | Skrovan | |
| 6,206,754 | B1 | 3/2001 | Moore | |
| 6,206,756 | B1 | 3/2001 | Chopra et al. | |
| 6,206,769 | B1 | 3/2001 | Walker | |
| 6,208,425 | B1 | 3/2001 | Sandhu et al. | |
| 6,210,257 | B1 | 4/2001 | Carlson | |
| 6,213,845 | B1 | 4/2001 | Elledge | |
| 6,218,316 | B1 | 4/2001 | Marsh | |
| 6,220,936 | B1 | 4/2001 | Quek | |
| 6,227,955 | B1 | 5/2001 | Custer et al. | |
| 6,234,874 | B1 | 5/2001 | Ball | |
| 6,234,877 | B1 | 5/2001 | Koos et al. | |
| 6,234,878 | B1 | 5/2001 | Moore | |
| 6,237,483 | B1 | 5/2001 | Blalock | |
| 6,241,587 | B1 | 6/2001 | Drill et al. | |
| 6,250,994 | B1 | 6/2001 | Chopra et al. | |
| 6,251,785 | B1 | 6/2001 | Wright | |
| 6,261,151 | B1 | 7/2001 | Sandhu et al. | |
| 6,261,163 | B1 | 7/2001 | Walker et al. | |
| 6,264,532 | B1 * | 7/2001 | Meloni | 451/6 |
| 6,267,650 | B1 | 7/2001 | Hembree | |
| 6,273,786 | B1 | 8/2001 | Chopra et al. | |
| 6,273,796 | B1 | 8/2001 | Moore | |
| 6,276,996 | B1 | 8/2001 | Chopra | |
| 6,287,879 | B1 | 9/2001 | Gonzales et al. | |
| 6,290,572 | B1 | 9/2001 | Hofmann | |
| 6,301,006 | B1 | 10/2001 | Doan | |
| 6,306,012 | B1 | 10/2001 | Sabde | |
| 6,306,014 | B1 | 10/2001 | Walker et al. | |
| 6,306,768 | B1 | 10/2001 | Klein | |
| 6,312,558 | B1 | 11/2001 | Moore | |
| 6,319,420 | B1 | 11/2001 | Dow | |
| 6,323,046 | B1 | 11/2001 | Agarwal | |
| 6,328,632 | B1 | 12/2001 | Chopra | |
| 6,331,488 | B1 | 12/2001 | Doan et al. | |
| 6,343,974 | B1 | 2/2002 | Franca et al. | |
| 6,350,180 | B1 | 2/2002 | Southwick | |
| 6,350,691 | B1 | 2/2002 | Lankford | |
| 6,352,466 | B1 | 3/2002 | Moore | |
| 6,354,923 | B1 | 3/2002 | Lankford | |
| 6,354,930 | B1 | 3/2002 | Moore | |
| 6,358,122 | B1 | 3/2002 | Sabde et al. | |
| 6,358,127 | B1 | 3/2002 | Carlson et al. | |
| 6,358,129 | B1 | 3/2002 | Dow | |
| 6,361,417 | B1 | 3/2002 | Walker et al. | |
| 6,362,105 | B1 | 3/2002 | Moore | |
| 6,364,746 | B1 | 4/2002 | Moore | |
| 6,364,757 | B1 | 4/2002 | Moore | |
| 6,368,190 | B1 | 4/2002 | Easter et al. | |
| 6,368,193 | B1 | 4/2002 | Carlson et al. | |
| 6,368,194 | B1 | 4/2002 | Sharples et al. | |
| 6,368,197 | B1 | 4/2002 | Elledge | |

| | | | | |
|---|---|---|---|---|
| 6,376,381 | B1 | 4/2002 | Sabde | |
| 6,537,133 | B1 | 3/2003 | Birang et al. | |
| 6,554,688 | B1 | 4/2003 | Lacy | |
| 6,616,513 | B1 * | 9/2003 | Osterheld | 451/56 |
| 6,684,704 | B1 * | 2/2004 | Obeng | 73/602 |
| 6,722,943 | B1 * | 4/2004 | Joslyn | 451/5 |
| 2004/0176018 | A1 | 9/2004 | Elledge et al. | |
| 2005/0026545 | A1 | 2/2005 | Elledge et al. | |
| 2005/0026546 | A1 | 2/2005 | Elledge et al. | |

OTHER PUBLICATIONS

Kondo, S. et al., "Abrasive-Free Polishing for Copper Damascene Interconnection," Journal of The Electrochemical Society, vol. 147, No. 10, pp. 3907-3913, 2000, The Electrochemical Society, Inc.

* cited by examiner

SYSTEMS AND METHODS FOR MONITORING CHARACTERISTICS OF A POLISHING PAD USED IN POLISHING MICRO-DEVICE WORKPIECES

CROSS-REFERENCE TO RELATED APPLICATION

This application is a divisional of U.S. application Ser. No. 10/379,035, entitled "SYSTEMS AND METHODS FOR MONITORING CHARACTERISTICS OF A POLISHING PAD USED IN POLISHING MICRO-DEVICE WORKPIECES," filed Mar. 3, 2003 now U.S. Pat. No. 6,872,132, which is incorporated herein by reference in its entirety.

TECHNICAL FIELD

The present invention relates to systems and methods for monitoring characteristics of a polishing pad used in polishing micro-device workpieces.

BACKGROUND

Mechanical and chemical-mechanical planarization processes (collectively "CMP") remove material from the surface of micro-device workpieces in the production of microelectronic devices and other products. FIG. 1 schematically illustrates a rotary CMP machine 10 with a platen 20, a carrier head 30, and a planarizing pad 40. The CMP machine 10 may also have an under-pad 25 between an upper surface 22 of the platen 20 and a lower surface of the planarizing pad 40. A drive assembly 26 rotates the platen 20 (indicated by arrow F) and/or reciprocates the platen 20 back and forth (indicated by arrow G). Since the planarizing pad 40 is attached to the under-pad 25, the planarizing pad 40 moves with the platen 20 during planarization.

The carrier head 30 has a lower surface 32 to which a micro-device workpiece 12 may be attached, or the workpiece 12 may be attached to a resilient pad 34 under the lower surface 32. The carrier head 30 may be a weighted, free-floating wafer carrier, or an actuator assembly 36 may be attached to the carrier head 30 to impart rotational motion to the micro-device workpiece 12 (indicated by arrow J) and/or reciprocate the workpiece 12 back and forth (indicated by arrow I).

The planarizing pad 40 and a planarizing solution 44 define a planarizing. medium that mechanically and/or chemically-mechanically removes material from the surface of the micro-device workpiece 12. The planarizing solution 44 may be a conventional CMP slurry with abrasive particles and chemicals that etch and/or oxidize the surface of the micro-device workpiece 12, or the planarizing solution 44 may be a "clean" nonabrasive planarizing solution without abrasive particles. In most CMP applications, abrasive slurries with abrasive particles are used on nonabrasive polishing pads, and clean nonabrasive solutions without abrasive particles are used on fixed-abrasive polishing pads.

To planarize the micro-device workpiece 12 with the CMP machine 10, the carrier head 30 presses the workpiece 12 face-down against the planarizing pad 40. More specifically, the carrier head 30 generally presses the micro-device workpiece 12 against the planarizing solution 44 on a planarizing surface 42 of the planarizing pad 40, and the platen 20 and/or the carrier head 30 moves to rub the workpiece 12 against the planarizing surface 42. As the micro-device workpiece 12 rubs against the planarizing surface 42, the planarizing medium removes material from the face of the workpiece 12.

The CMP process must consistently and accurately produce a uniformly planar surface on the micro-device workpiece 12 to enable precise fabrication of circuits and photopatterns. One problem with conventional CMP methods is that the planarizing surface 42 of the planarizing pad 40 can wear unevenly, causing the pad 40 to have a non-planar planarizing surface 42. Another concern is that the surface texture of the planarizing pad 40 may not change uniformly over time. Still another problem with CMP processing is that the planarizing surface 42 can become glazed with accumulations of planarizing solution 44, material removed from the micro-device workpiece 12, and/or material from the planarizing pad 40.

To restore the planarizing characteristics of the planarizing pad 40, the accumulations of waste matter are typically removed by conditioning the planarizing pad 40. Conditioning involves delivering a conditioning solution to the planarizing surface 42 of the planarizing pad 40 and moving a conditioner 50 across the pad 40. The conventional conditioner 50 includes an abrasive end effector 51 generally embedded with diamond particles and a separate actuator 55 coupled to the end effector 51 to move it rotationally, laterally, and/or axially, as indicated by arrows A, B, and C, respectively. The typical end effector 51 removes a thin layer of the planarizing pad material along with the waste matter, thereby forming a more planar, clean planarizing surface 42 on the planarizing pad 40.

One concern with conventional CMP methods is the difficulty of accurately measuring characteristics of the planarizing pad, such as pad thickness, contour, and texture. Conventional devices for measuring characteristics of the pad include contact devices and noncontact devices. Contact devices, such as probes and stylets, physically measure the planarizing pad. Contact devices, however, are inaccurate and are limited by their diameter. In addition, contact devices are limited by their ability to be used during a planarizing cycle. Noncontact devices, such as optical systems, are also inaccurate when used in-situ because the liquid medium on the planarizing pad distorts or obscures the measurements. In addition, many of these devices cannot be used in-situ because of their size. Accordingly, there is a need for a system that accurately measures the characteristics of a planarizing pad during and/or between planarizing cycles or conditioning cycles in-situ.

SUMMARY

The present invention is directed toward systems and methods for monitoring characteristics of a polishing pad used in polishing a micro-device workpiece, methods for conditioning the polishing pad, and methods for polishing the micro-device workpiece. One aspect of the invention is directed toward methods for monitoring a characteristic of a polishing pad used for polishing a micro-device workpiece. In one embodiment, a method includes applying ultrasonic energy to the polishing pad and determining a status of the characteristic based on a measurement of the ultrasonic energy applied to the polishing pad. In one aspect of this embodiment, applying ultrasonic energy includes applying ultrasonic energy from a transducer. The transducer can be carried by a conditioner, a fluid arm, a micro-device workpiece carrier, or a table. In another aspect of this embodiment, determining the status of the characteristic includes determining a thickness, density, surface contour, roughness, or texture of the polishing pad.

Another aspect of the invention is directed toward methods for conditioning a polishing pad used for polishing a micro-device workpiece. In one embodiment, a method includes applying ultrasonic energy to the polishing pad and determining a status of the characteristic of the polishing pad based on a measurement of the ultrasonic energy applied to the polishing pad. The method further includes adjusting at least one conditioning parameter in response to the determined status of the characteristic of the polishing pad. In one aspect of this embodiment, applying ultrasonic energy includes transmitting ultrasonic energy with a frequency of at least approximately 10 MHz to the polishing pad. In another aspect of this embodiment, the procedure of adjusting at least one conditioning parameter includes adjusting the downward force or sweep velocity of an end effector.

Another aspect of the invention is directed toward methods for polishing a micro-device workpiece. In one embodiment, a method includes pressing the micro-device workpiece against a polishing pad and moving the workpiece relative to the polishing pad, applying ultrasonic energy to a first region of the polishing pad, and determining a status of a characteristic of the first region of the polishing pad based on a measurement of the ultrasonic energy applied to the first region. The ultrasonic energy can be applied to the pad while moving the workpiece relative to the pad or during a separate conditioning cycle. The method further includes adjusting at least one polishing parameter in response to the determined status of the characteristic of the first region. In one aspect of this embodiment, adjusting at least one polishing parameter includes adjusting the downward force and/or sweep area of the micro-device workpiece.

Another aspect of the invention is directed toward systems for monitoring a characteristic of a polishing pad used for polishing a micro-device workpiece. In one embodiment, a system includes a polishing pad having a characteristic, a transducer for applying ultrasonic energy to the polishing pad, and a controller operatively coupled to the transducer. The controller has a computer-readable medium containing instructions to perform at least one of the above-mentioned methods.

DETAILED DESCRIPTION

The present invention is directed to systems and methods for monitoring characteristics of a polishing pad used in polishing micro-device workpieces. The term "micro-device workpiece" is used throughout to include substrates in and/or on which micro-mechanical devices, data storage elements, and other features are fabricated. For example, micro-device workpieces can be semiconductor wafers, glass substrates, insulated substrates, or many other types of substrates. Furthermore, the terms "planarizing" and "planarization" mean either forming a planar surface and/or forming a smooth surface (e.g., "polishing"). Several specific details of the invention are set forth in the following description and in FIGS. 2–8 to provide a thorough understanding of certain embodiments of the invention. One skilled in the art, however, will understand that the present invention may have additional embodiments, or that the other embodiments of the invention may be practiced without several of the specific features explained in the following description.

Figure 1:
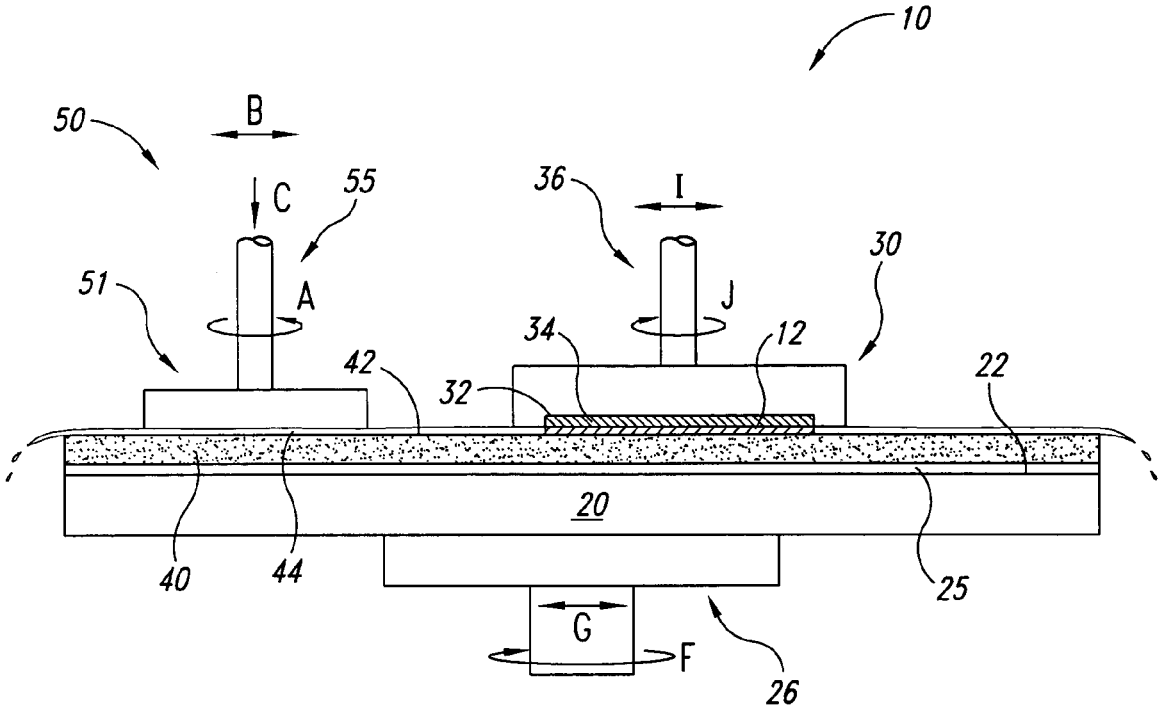
Fig. 1 (Prior Art)
FIG. 1 is a schematic cross-sectional view of a portion of a rotary planarizing machine and an abrasive end effector in accordance with the prior art.
Figure 2:
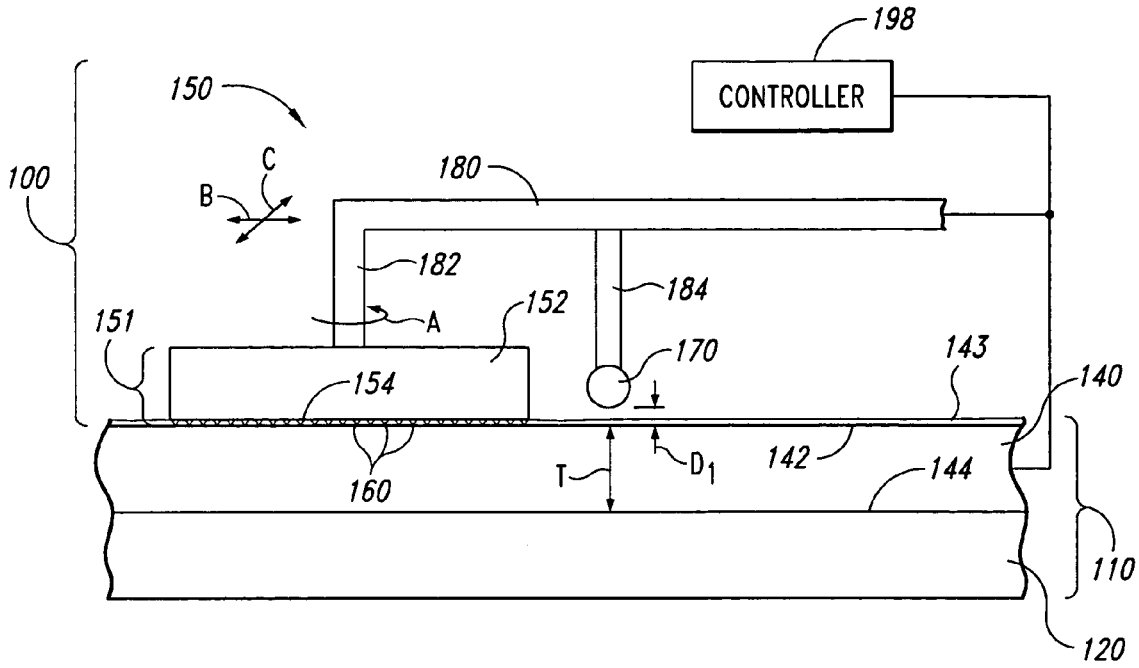
FIG. 2 is a schematic cross-sectional view of a system for monitoring the characteristics of a planarizing pad in accordance with one embodiment of the invention.

FIG. 2 is a schematic cross-sectional view of a system 100 for monitoring the characteristics of a planarizing pad 140 in accordance with one embodiment of the invention. The system 100 includes a conditioner 150, a transducer 170, and a controller 198 operatively coupled to the conditioner 150 and the transducer 170. The system 100 is coupled to a CMP machine 110 similar to the CMP machine 10 discussed above with reference to FIG. 1. For example, the CMP machine 110 includes a platen 120 and a planarizing pad 140 carried by the platen 120.

The conditioner 150 includes an end effector 151, a first arm 180, and a second arm 182 coupled to the end effector 151. The end effector 151 refurbishes the planarizing pad 140 on the CMP machine 110 to bring a planarizing surface 142 of the pad 140 to a desired state for consistent performance. In the illustrated embodiment, the end effector 151 includes a plate 152 and a plurality of contact elements 160 projecting from the plate 152. The plate 152 can be a circular member having a contact surface 154 configured to contact the planarizing surface 142 of the planarizing pad 140. The contact elements 160 can be integral portions of the plate 152 or discrete elements coupled to the plate 152. In the illustrated embodiment, the contact elements 160 are small diamonds attached to the contact surface 154 of the plate 152. The first arm 180 moves the end effector 151 laterally across the planarizing pad 140 in a direction B and/or C, and the second arm 182 rotates the end effector 151 in a direction A so that the contact elements 160 abrade the planarizing surface 142 of the planarizing pad 140.

In the illustrated embodiment, the transducer 170 is coupled to the conditioner 150 to move across the planarizing pad 140 and monitor the characteristics of the pad 140. A transducer arm 184 couples the transducer 170 to the first arm 180 of the conditioner 150 and positions the transducer 170 proximate to the planarizing pad 140. Accordingly, the transducer 170 is spaced apart from the planarizing pad 140 by a distance $D_1$ as it moves with the end effector 151 laterally across the pad 140.

The transducer 170 is configured to transmit ultrasonic energy toward the planarizing pad 140 to determine the status of a characteristic of the pad 140. For example, the transducer 170 can determine the thickness of the pad 140, the density of the pad 140, and/or a surface condition on the pad 140, such as pad roughness, texture, and/or contour. Moreover, the transducer 170 can determine if the pad 140 was installed properly so that there are not lifting problems such as bubbles between the pad 140 and the subpad (not shown) or the platen 120. In one embodiment, for example, the transducer 170 can determine the thickness T of the planarizing pad 140 by transmitting ultrasonic waves toward the pad 140. The planarizing surface 142 of the pad 140 reflects a first portion of the ultrasonic waves back to the transducer 170, and a bottom surface 144 of the pad 140 reflects a second portion of the waves back to the transducer 170. The thickness T of the planarizing pad 140 is calculated from the difference between the time the first portion of the waves returns to the transducer 170 and the time the second portion of the waves returns to the transducer 170. In other embodiment, the transducer 170 can determine the status of a characteristic of a subpad or an under-pad.

Figure 3:
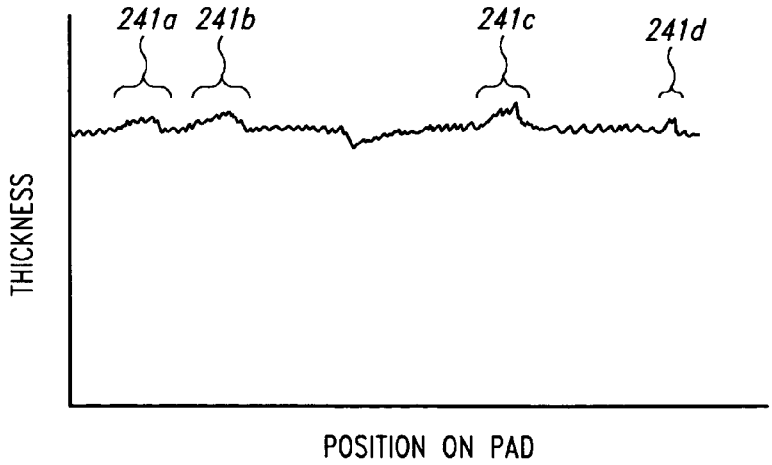
FIG. 3 is a graph of the thickness of one region of the planarizing pad of FIG. 2.

The status of the characteristics of the planarizing pad 140 can be tracked as the transducer 170 moves over the pad 140. For example, FIG. 3 is a graph of the thickness T of the planarizing pad 140 as measured by the transducer 170 during one sweep across the pad 140. The peaks (identified individually as 241*a–d*) represent regions of the planarizing pad 140 that have a greater thickness because they have experienced less erosion than other regions of the pad 140. A three-dimensional model can also be created as the transducer 170 moves across the planarizing pad 140.

Referring back to FIG. 2, in one embodiment the transducer 170 is configured to transmit ultrasonic energy having a low power and a high frequency, such as a frequency of approximately 10 MHz or higher. In one aspect of this embodiment, the transducer 170 can transmit ultrasonic energy having a frequency of approximately 50 MHz or higher. In another aspect of this embodiment, the transducer 170 can transmit ultrasonic energy having a frequency of approximately 100 MHz or higher. In yet another aspect of this embodiment, the transducer 170 transmits ultrasonic energy at a frequency high enough to avoid cavitation in the conditioning solution 143 on the planarizing surface 142 of the pad 140. Cavitation can be used in cleaning the pad 140 and typically occurs at frequencies less than 1 MHz. In one embodiment, the frequency of the ultrasonic energy can be related to the resolution of the transducer. For example, a transducer can have a resolution of approximately 1–1.5 microns with a frequency of 100 MHz. In other embodiments, the resolution can be different.

In the illustrated embodiment, the system 100 uses a noncontact method to transmit ultrasonic energy to the planarizing pad 140. Suitable noncontact ultrasonic systems are manufactured by SecondWave Systems of Boalsburg, Pa. In additional embodiments, the system 100 may not use a noncontact method. More specifically, the transducer 170 can use the conditioning solution 143, a planarizing solution, or any other liquid and/or solid medium to transmit the ultrasonic energy to the planarizing pad 140.

In the illustrated embodiment, the controller 198 is operatively coupled to the conditioner 150 and the transducer 170 to adjust the conditioning parameters based on the status of a characteristic of the planarizing pad 140. For example, if the transducer 170 and the controller 198 determine that a region of the planarizing pad 140 has a greater thickness T than other regions of the pad 140, the controller 198 can adjust the conditioning parameters to provide a desired thickness in the region. More specifically, the controller 198 can change the downward force of the end effector 151, the dwell time of the end effector 151, and/or the relative velocity between the planarizing pad 140 and the end effector 151 to remove more or less material from the pad 140. The transducer 170 and controller 198 can similarly determine the status of other characteristics of the planarizing pad 140 and adjust the conditioning parameters to provide a desired status of the characteristics of the pad 140. In one aspect of this embodiment, the controller 198 can be coupled to an automated process controller, a database, and/or a SECS/GEM to control the process parameters.

In additional embodiments, the system 100 can include a micro-device workpiece carrier in addition to or in the place of the conditioner 150. In either of these embodiments, the transducer 170 can be coupled to the micro-device workpiece carrier, and the workpiece carrier can be operatively coupled to the controller 198. Accordingly, the controller 198 can adjust the planarizing parameters in response to the status of a characteristic of the planarizing pad 140. For example, the micro-device workpiece carrier can adjust the downward force on the micro-device workpiece or the workpiece carrier can avoid planarizing the workpiece on certain regions of the planarizing pad 140 in response to the status of a characteristic of the pad 140.

One advantage of the system 100 of the illustrated embodiment is that a characteristic of the planarizing pad 140 can be accurately monitored before and during the conditioning and/or planarizing cycles. Consequently, the system 100 can monitor the wear of the planarizing pad 140 to predict the life of the pad 140. Furthermore, an abnormal wear or erosion rate may indicate a problem with the pad 140 and/or the system 100. In addition, the system 100 can adjust the conditioning parameters in response to the status of a characteristic of the pad 140 to provide a desired status of the characteristic. Moreover, the system 100 can adjust the planarizing parameters to provide a planar surface on the micro-device workpiece in spite of the status of a characteristic of the pad 140. In addition, the system 100 can predict the polishing rate and polishing uniformity of a micro-device workpiece based on the status of a characteristic of the planarizing pad 140.

Figure 4:
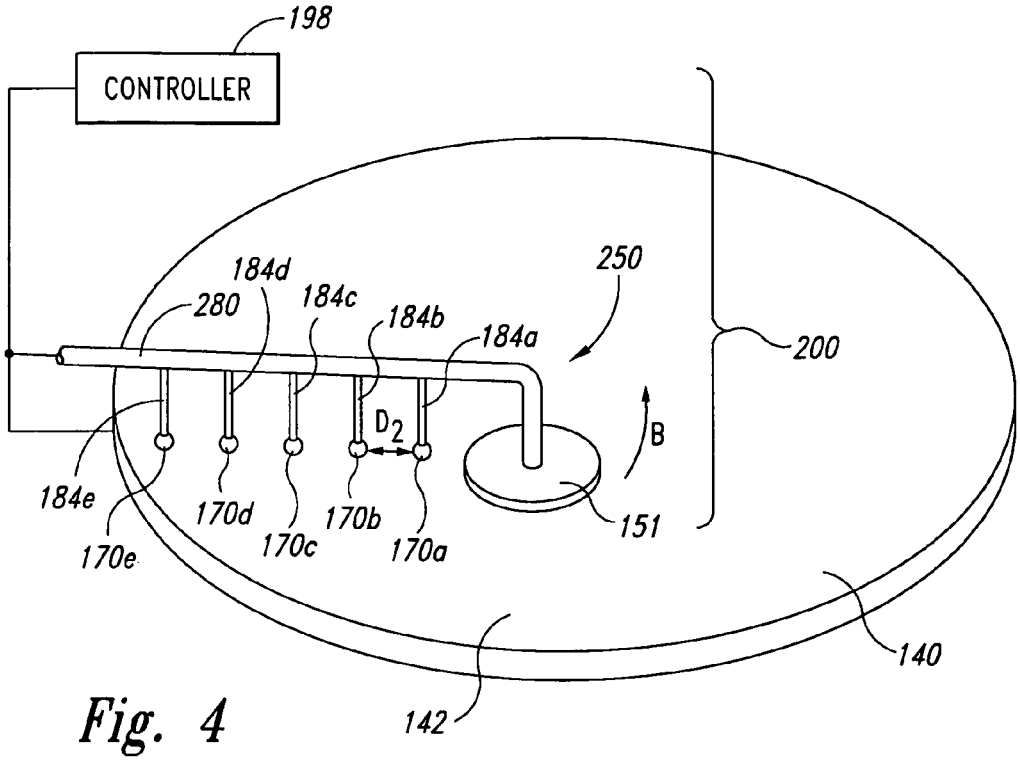
FIG. 4 is a schematic isometric view of a system for monitoring the characteristics of the planarizing pad in accordance with another embodiment of the invention.

FIG. 4 is a schematic isometric view of a system 200 for monitoring the characteristics of the planarizing pad 140 in accordance with another embodiment of the invention. The system 200 includes a conditioner 250, a plurality of transducers 170 (identified individually as 170*a–e*) coupled to the conditioner 250, and a controller 198 operatively coupled to the transducers 170 and the conditioner 250. The conditioner 250 includes an arm 280 and an end effector 151 coupled to the arm 280. A plurality of transducer arms 184 (identified individually as 184*a–e*) couple the transducers 170 to the arm 280 of the conditioner 250. Each transducer 170 is spaced apart from an adjacent transducer 170 by a distance $D_2$. In operation, the transducers 170 are swept across different regions of the planarizing pad 140 as the conditioner 250 moves across the pad 140 in the direction B. Each transducer 170 can determine the status of a characteristic of the planarizing pad 140 in each region of the pad 140. As discussed above with reference to FIG. 2, the controller 198 can adjust the conditioning parameters in response to the determined status of a characteristic of the pad 140. In additional embodiments, the transducers 170 can be coupled to the arm of a micro-device workpiece carrier.

Figure 5:
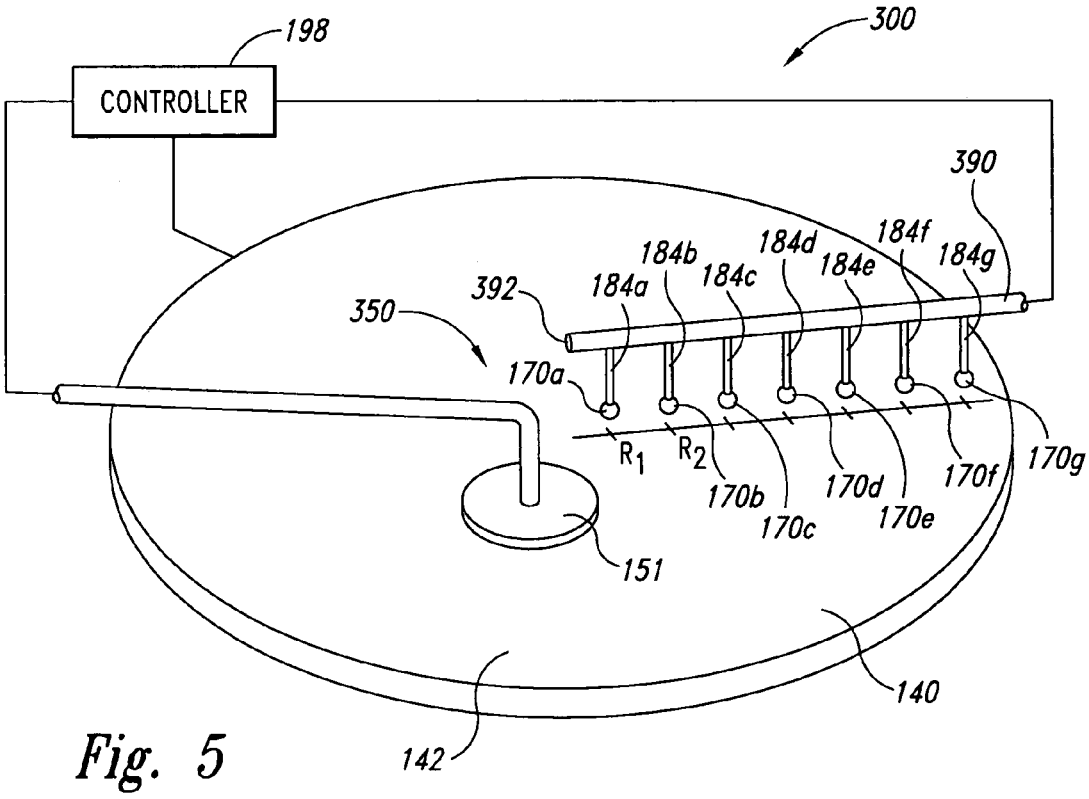
FIG. 5 is a schematic isometric view of a system for monitoring the characteristics of the planarizing pad in accordance with another embodiment of the invention.

FIG. 5 is a schematic isometric view of a system 300 for monitoring the characteristics of the planarizing pad 140 in accordance with another embodiment of the invention. The system 300 includes a conditioner 350, a fluid arm 390 with a plurality of transducers 170 (identified individually as 170*a–g*), and a controller 198 operatively coupled to the conditioner 350 and the transducers 170. The fluid arm 390 extends radially from the center of the planarizing pad 140 to the perimeter of the pad 140. The fluid arm 390 includes an outlet 392 to deliver planarizing and/or conditioning solution to the planarizing pad 140. The transducers 170 are coupled to the fluid arm 390 by a plurality of transducer arms 184 (identified individually as 184*a–g*). In the illustrated embodiment, each transducer 170 monitors a characteristic of the planarizing pad 140 at a specific radius of the pad 140. For example, a first transducer 170*a* determines the status of a characteristic of the planarizing pad 140 at a first radius $R_1$ of the pad 140, and a second transducer 170*b* determines the status of a characteristic of the pad 140 at a second radius $R_2$ different from the first radius $R_1$. Similarly, the other transducers 170 determine the status of a characteristic of the planarizing pad 140 at different radii. In additional embodiments, the fluid arm 390 and the transducers 170 can be movable across to the planarizing pad 140.

Figure 6:
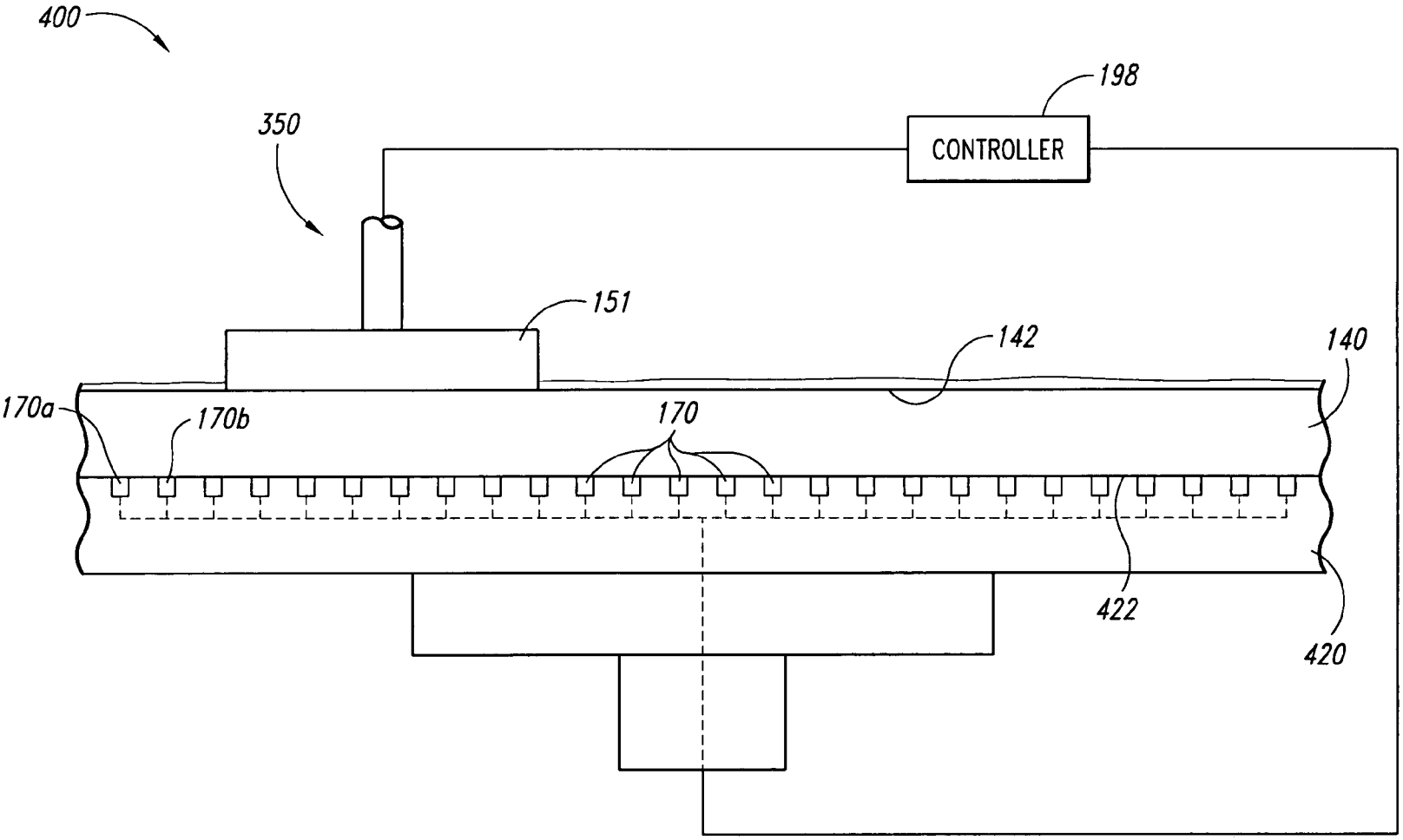
FIG. 6 is a schematic side view of a system for monitoring the characteristics of the planarizing pad in accordance with another embodiment of the invention.

FIG. 6 is a schematic side view of a system 400 for monitoring the characteristics of the planarizing pad 140 in accordance with another embodiment of the invention. The system 400 includes a controller 198 and a platen 420 carrying a plurality of transducers 170 operatively coupled to the controller 198. The transducers 170 are arranged proximate to an upper surface 422 of the platen 420 to determine the status of a characteristic in specific regions of the planarizing pad 140. For example, a first transducer 170*a* determines the status of a characteristic in the first region of the planarizing pad 140. Similarly, a second transducer 170*b* determines the status of a characteristic in a second region of the planarizing pad 140.

Figure 7A:
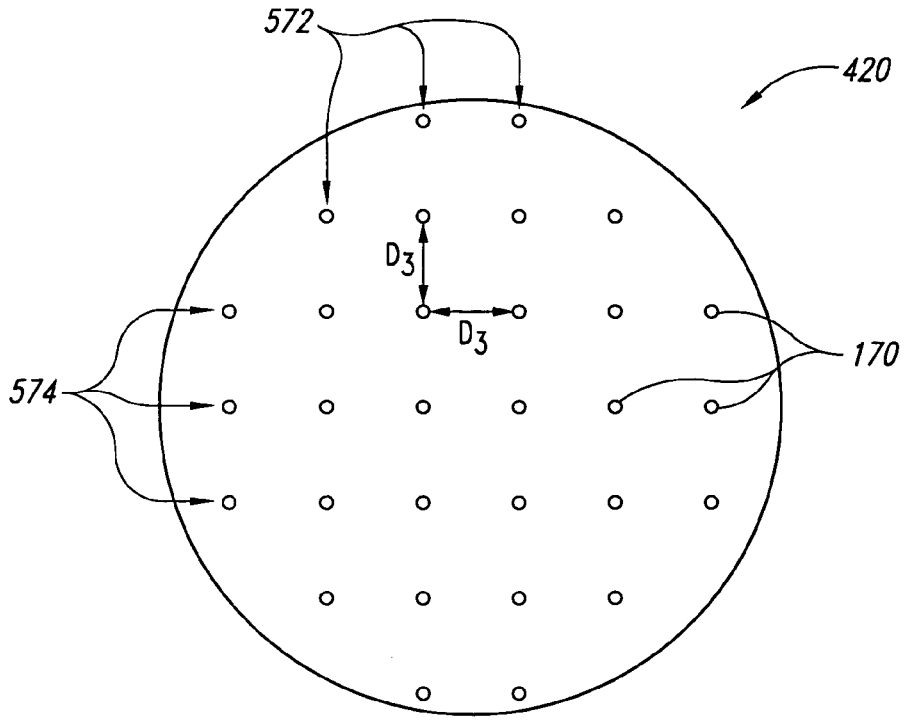
FIG. 7A is a top view of the platen of FIG. 6.
Figure 7B:
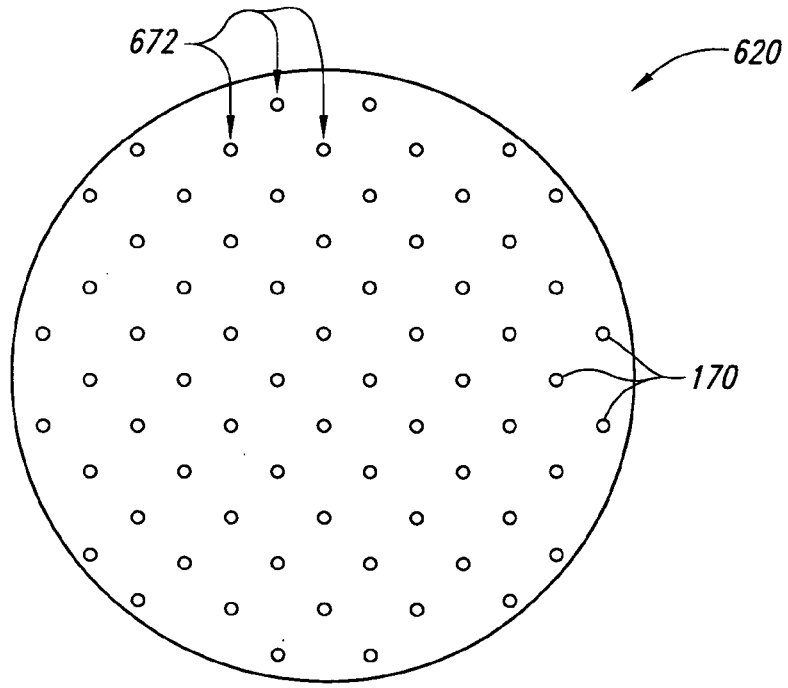
FIG. 7B is a top view of a platen in accordance with another embodiment of the invention.

FIG. 7A is a top view of the platen 420 of FIG. 6. The transducers 170 are arranged in a grid having columns 572 and rows 574 on the platen 420. Each transducer 170 is spaced apart from an adjacent transducer 170 by a distance $D_3$. FIG. 7B is a top view of a platen 620 in accordance with another embodiment of the invention. The platen 620 is configured for use with a system similar to the system 400 discussed above with reference to FIG. 6. The transducers 170 are arranged in staggered columns 672 with the transducers 170 in one column 672 offset transversely from neighboring transducers 170 in adjacent columns 672. In other embodiments, the transducers 170 can be arranged in other patterns on the platen 620, or the transducers 170 can be randomly distributed over the platen 620.

Figure 8:
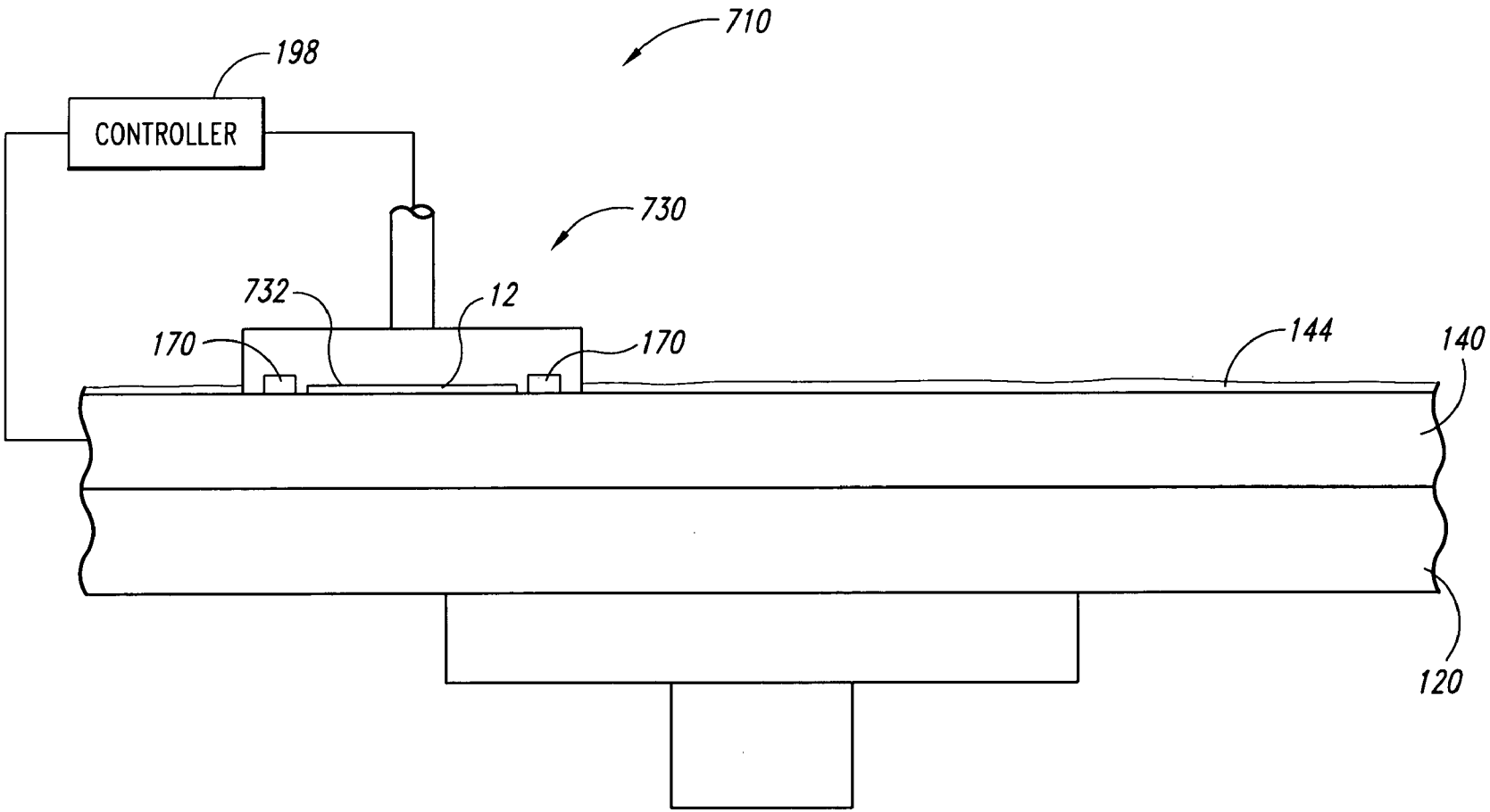
FIG. 8 is a schematic side view of a CMP machine having transducers in accordance with another embodiment of the invention.

FIG. 8 is a schematic side view of a CMP machine 710 having transducers 170 in accordance with another embodiment of the invention. The CMP machine 710 can be generally similar to the CMP machine 10 described above with reference to FIG. 1. For example, the CMP machine 710 can include a platen 120, a planarizing pad 140 carried by the platen 120, and a micro-device workpiece carrier 730 having a lower surface 732 to which a micro-device workpiece 12 is attached. The micro-device workpiece carrier 730 also includes a plurality of transducers 170 arranged proximate to the lower surface 732 of the workpiece carrier 730. The transducers 170 monitor a characteristic of the planarizing pad 140 during the planarizing process. The transducers 170 and the micro-device workpiece carrier 730 can be operably coupled to the controller 198. Accordingly, the controller 198 can adjust the planarizing parameters in response to the status of a characteristic of the planarizing pad 140. In other embodiments, the micro-device workpiece carrier 730 can include transducers 170 positioned at other locations on the workpiece carrier 730.

From the foregoing, it will be appreciated that specific embodiments of the invention have been described herein for purposes of illustration, but that various modifications may be made without deviating from the spirit and scope of the invention. Accordingly, the invention is not limited except as by the appended claims.

We claim:

1. A method for monitoring a characteristic of a polishing pad used for polishing a micro-device workpiece, comprising:

applying ultrasonic energy to the polishing pad; and determining a status of the characteristic based on a measurement of the ultrasonic energy applied to the polishing pad;

wherein applying ultrasonic energy comprises transmitting ultrasonic energy from a transducer at a table supporting the polishing pad.

2. The method of claim 1 wherein applying ultrasonic energy comprises transmitting ultrasonic energy with a frequency of at least approximately 10 MHz to the polishing pad.

3. The method of claim 1 wherein applying ultrasonic energy comprises transmitting ultrasonic energy with a frequency of at least approximately 50 MHz to the polishing pad.

4. The method of claim 1 wherein applying ultrasonic energy comprises transmitting ultrasonic energy with a frequency of at least approximately 100 MHz to the polishing pad.

5. The method of claim 1 wherein applying ultrasonic energy comprises transmitting ultrasonic energy without causing cavitation in a solution on the polishing pad.

6. The method of claim 1 wherein determining the status of the characteristic comprises determining a thickness of the polishing pad.

7. The method of claim 1 wherein determining the status of the characteristic comprises determining a surface contour on the polishing pad.

8. The method of claim 1 wherein determining the status of the characteristic comprises determining a roughness of the polishing pad.

9. The method of claim 1 wherein determining the status of the characteristic comprises determining a texture of the polishing pad.

10. The method of claim 1 wherein determining the status of the characteristic comprises determining a density of the polishing pad.

11. The method of claim 1, further comprising tracking the status of the characteristic to monitor erosion of the polishing pad.

12. The method of claim 1, further comprising generating a profile of the polishing pad based on the status of the characteristic.

13. The method of claim 1, further comprising adjusting at least one conditioning parameter in response to the determined status of the characteristic of the polishing pad.

14. A method for monitoring a characteristic of a polishing pad used for polishing a micro-device workpiece, comprising:

applying ultrasonic energy to a first region of the polishing pad with a transducer at a table supporting the polishing pad;

determining a first status of the characteristic based on a measurement of the ultrasonic energy applied to the first region of the polishing pad;

applying ultrasonic energy to a second region spaced apart from the first region of the polishing pad; and determining a second status of the characteristic based on a measurement of the ultrasonic energy applied to the second region of the polishing pad.

15. The method of claim 14, further comprising generating a profile of the polishing pad based on the first and second statuses of the characteristic.

16. The method of claim 14 wherein applying ultrasonic energy to the first region comprises transmitting ultrasonic energy with a frequency of at least approximately 10 MHz to the polishing pad.

17. The method of claim 14 wherein applying ultrasonic energy to the first region comprises transmitting ultrasonic energy without causing cavitation in a solution on the polishing pad.

18. The method of claim 14 wherein:

the transducer is a first transducer;

applying ultrasonic energy to the first region comprises transmitting ultrasonic energy with the first transducer to the first region at a frequency of at least approximately 10 MHz; and applying ultrasonic energy to the second region comprises transmitting ultrasonic energy with a second transducer different than the first transducer to the second region at a frequency of at least approximately 10 MHz.

19. The method of claim 14, further comprising tracking the first status of the characteristic to monitor erosion of the first region of the polishing pad.

20. The method of claim 14 wherein determining the first status of the characteristic comprises determining a surface condition on the polishing pad.

21. The method of claim 14 wherein determining the first status of the characteristic comprises determining a thickness of the polishing pad.

22. A method for polishing a micro-device workpiece, comprising:

pressing the micro-device workpiece against a polishing pad and moving the workpiece relative to the polishing pad;

applying ultrasonic energy to a first region of the polishing pad at a frequency of at least approximately 10 MHz with a transducer at a table supporting the polishing pad;

determining a status of a characteristic of the first region of the polishing pad based on a measurement of the ultrasonic energy applied to the first region; and adjusting at least one polishing parameter in response to the determined status of the characteristic of the first region.

23. The method of claim 22 wherein adjusting at least one polishing parameter comprises adjusting the downward force of the micro-device workpiece against the polishing pad.

24. The method of claim 22 wherein adjusting at least one polishing parameter comprises adjusting the sweep area of the micro-device workpiece across the polishing pad.

25. The method of claim 22 wherein applying ultrasonic energy comprises transmitting ultrasonic energy with a frequency of at least approximately 50 MHz.

26. The method of claim 22 wherein determining the status of the characteristic comprises determining a surface condition on the first region of the polishing pad.

27. A system for monitoring a characteristic of a polishing pad used for polishing a micro-device workpiece, comprising:

a polishing pad having a characteristic;

a table supporting the polishing pad;

a transducer at the table and positioned to apply ultrasonic energy to the polishing pad; and a controller operatively coupled to the transducer, the controller having a computer-readable medium containing instructions to perform a method comprising applying ultrasonic energy to the polishing pad; and determining a status of the characteristic of the polishing pad based on a measurement of the ultrasonic energy applied to the polishing pad.

28. The system of claim 27 wherein the transducer is configured to apply ultrasonic energy at a frequency of at least approximately 10 MHz to the polishing pad.

29. A system for monitoring a characteristic of a polishing pad used for polishing a micro-device workpiece, comprising:

a polishing pad having a characteristic, a first region, and a second region spaced apart from the first region;

a table supporting the polishing pad;

a transducer at the table and positioned to apply ultrasonic energy to the polishing pad; and a controller operatively coupled to the transducer, the controller having a computer-readable medium containing instructions to perform a method comprising applying ultrasonic energy to the first region of the polishing pad;

determining a first status of the characteristic based on a measurement of the ultrasonic energy applied to the first region of the polishing pad;

applying ultrasonic energy to a second region of the polishing pad; and determining a second status of the characteristic based on a measurement of the ultrasonic energy applied to the second region of the polishing pad.

30. The system of claim 29 wherein the transducer is configured to apply ultrasonic energy at a frequency of at least approximately 10 MHz to the polishing pad.

31. A system for polishing a micro-device workpiece, comprising:

a polishing pad having a characteristic;

a table supporting the polishing pad;

a micro-device workpiece carrier over the polishing pad, the micro-device workpiece carrier being configured to carry the micro-device workpiece;

a transducer at the table and positioned to apply ultrasonic energy to the polishing pad; and a controller operatively coupled to the micro-device workpiece carrier and the transducer, the controller having a computer-readable medium containing instructions to perform a method comprising pressing the micro-device workpiece against the polishing pad and moving the micro-device workpiece relative to the polishing pad;

applying ultrasonic energy to the polishing pad;

determining a status of the characteristic of the polishing pad based on a measurement of the ultrasonic energy applied to the polishing pad; and adjusting at least one polishing parameter in response to the determined status of the characteristic of the polishing pad.

32. The system of claim 31 wherein the transducer is configured to apply ultrasonic energy at a frequency of at least approximately 10 MHz to the polishing pad.

33. A system for monitoring a characteristic of a polishing pad used for polishing a micro-device workpiece, comprising:

a table;

a polishing pad carried by the table, the polishing pad having a characteristic; and a transducer at the table, the transducer being configured to apply ultrasonic energy to the polishing pad at a frequency of at least approximately 10 MHz to determine a status of the characteristic of the polishing pad.

34. The system of claim 33, further comprising a controller operatively coupled to the transducer to determine a thickness of the polishing pad based on a measurement of the ultrasonic energy applied to the polishing pad.

35. The system of claim 33, further comprising a controller operatively coupled to the transducer to determine a surface condition on the polishing pad based on a measurement of the ultrasonic energy applied to the polishing pad.

* * * * *